United States Patent [19]

Andersen et al.

[11] Patent Number: 4,842,043

[45] Date of Patent: Jun. 27, 1989

[54] MOLD STIRRER

[75] Inventors: Ingvar T. Andersen; Jan E. Eriksson, both of Helsingborg, Sweden

[73] Assignee: Asea Brown Boveri AB, Västerås, Sweden

[21] Appl. No.: 180,326

[22] Filed: Apr. 11, 1988

[30] Foreign Application Priority Data

Apr. 16, 1987 [SE] Sweden ..... 8701615

[51] Int. Cl.[4] ..... B22D 27/02

[52] U.S. Cl. ..... 164/504; 164/147.1

[58] Field of Search ..... 164/468, 504, 502, 147.1, 164/466, 498, 499

[56] References Cited

U.S. PATENT DOCUMENTS 4,457,354 7/1984 Dantzig et al. ..... 164/504

FOREIGN PATENT DOCUMENTS 2803503 8/1978 Fed. Rep. of Germany ..... 164/504

*Primary Examiner*—Kuang Y. Lin

*Attorney, Agent, or Firm*—Watson, Cole, Grindle & Watson

[57] ABSTRACT

For stirring molten metal in continuous casting at least two stirrer members are placed outside the mold on opposite sides thereof, the stirrer members being provided with iron cores and surrounding coils. Intermediate iron cores can be arranged between the stirrer members to form a closed magnetic circuit around the mold, whereby horizontal rotation of molten metal in the strand can be achieved.

9 Claims, 1 Drawing Sheet

MOLD STIRRER

BACKGROUND OF THE INVENTION

The present invention relates to the continuous casting of electromagnetically stirrable materials and in particular relates to a mold stirrer for stirring molten metal in a continuous casting process.

DISCUSSION OF THE PRIOR ART

Mold stirrers are usually made with a round or rectangular geometry since these shapes are appropriate for the cross-section of the molds usually employed to receive the strand (molten material being cast). Mold stirrers are commonly made in one piece and surround the strand (the mold) at a level where at least a substantial proportion of the material being cast remains molten.

One problem in this connection is that since there is a need for each stirrer to match the specific dimensions of the mold/strand, a range of different sized stirrers must be available or each must be made for a specific mold or mold size. It would thus be desirable to be able to make a mold stirrer adjustable to different dimensions of mold. Further, it is known to use molds of adjustable cross-section so that having a stirrer that could be adjustable with the mold would be very advantageous.

Sub-stirrers are known per se, which may cooperate with other sub-stirrers to bring about stirring of the non-solidified parts of a continuous strand at a selected position along the mold in the casting direction. However, this does not solve the problem of adjustability between different molds or different sizes of an adjustable mold.

SUMMARY OF THE INVENTION

One object of the present invention is to provide a solution to the above-mentioned problems and other related problems. The invention is characterized in that at least two stirrer members are located outside the mold on opposite sides thereof, these stirrer members being provided with iron cores and electrical coils surrounding the cores. Between adjacent parts of the iron cores of the stirrer members there may be inserted intermediate iron cores, which together with the cores in the stirrer members form a closed magnetic circuit around the mold, whereby a rotation of molten cast material can be achieved.

By virtue of the invention, for example by exchange of intermediate cores, it is possible to adapt the mold stirrer for different mold and strand dimensions. By a suitable choice of phase sequence for the different phases of the electrical power fed to the coils in the stirrer members, rotation of the non-solidified cast material normal to the casting direction can be obtained inside the mold. Each stirrer member can be a sub-stirrer which contains coils for half a stirrer, so that two cooperating stirrer members act together as one complete stirrer. However, each stirrer member can be an independent pluri-phase stirrer, the two or more stirrer members acting together in concert to achieve good stirring effects in the non-solidified parts of the cast strand. The intermediate iron cores are suitably easily exchangeable and/or are dimensioned for different strand and mold areas.

BRIEF DESCRIPTION OF THE DRAWINGS

The invention will now be described in greater detail, by way of example, with reference to the accompanying drawing, wherein.

DESCRIPTION OF PREFERRED EMBODIMENTS

Figure 1:
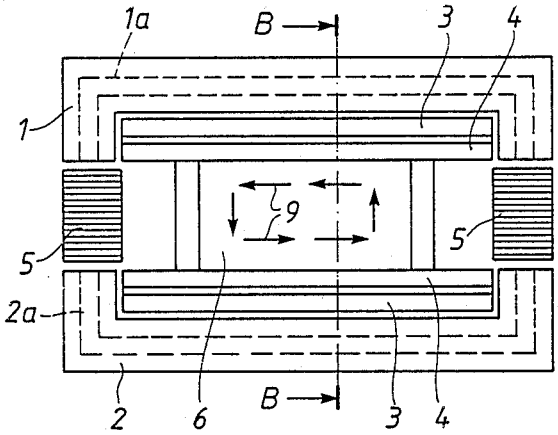
FIG. 1 is a plan from above of two sub-stirrers surrounding a mold and a continuous strand.
Figure 2:
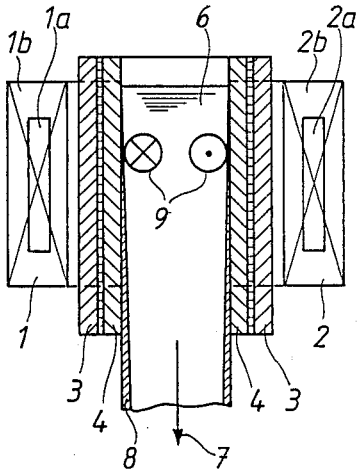
FIG. 2 is a section along the line B—B of FIG. 1 when the copper plates inside the mold are one piece plates.
Figure 3:
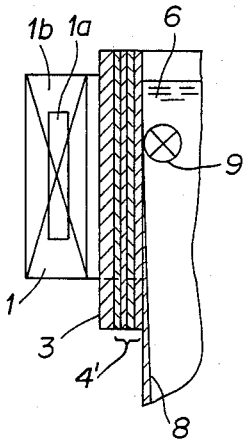
FIG. 3 is a partial section along the line B—B of FIG. 1 when the copper plates inside the mold are laminated plates.

FIG. 1 shows two sub-stirrers 1, 2, each of which partially surrounds a mold 3. Inside the mold 3 copper plates are placed in the usual manner. These plates can have a one piece construction (see elements 4 in FIG. 2) or they can be laminated (see elements 4' in FIG. 3). Each sub-stirrer 1 or 2 includes an iron core (1*a*, 2*a*) and at least one electrical coil (1*b*, 2*b*).

Between the confronting ends of the sub-stirrers 1, 2 are placed intermediate iron cores 5 of such a dimension that the cores 1*a*, 2*a* in the sub-stirrers and the intermediate iron cores 5 provide a magnetic circuit which surrounds the mold 3. The melt inside the mold 3 with its copper plates is shown at 6 and the solidified perimeter portions of cast material leaving the underside of the mold 3 are shown at 8 in FIG. 2. By a suitable choice of phase sequence for the pluri-phase (two-phase or three-phase) stirrers, a horizontal rotation of the melt as indicated by the arrows 9 can be obtained in the non-solidified parts of the strand. The arrow 7 designates the direction of casting.

The sub-stirrers 1, 2 are suitably arranged so that their iron cores 1*a*, 2*a* will each be in contact with each intermediate iron core 5. The intermediate iron cores 5 can be exchanged for cores 5 of different dimensions when the cross-section of the mold is changed, and the sub-stirrers 1, 2 can thus be used for a range of different dimensions of cast strand and hence of the mold.

The mold stirrer shown in FIG. 1 can thus consist of two main parts, each of which includes half a stirrer. The coils 1*b*, 2*b* in these stirrers are electrically connected together by wiring not shown so as to obtain a normal magnetic travelling field. For the smallest size of strand, no intermediate cores 5 would be required, since the cores 1*a*, 2*a* would combine, by themselves, to form a complete magnetic circuit around the mold. For larger sizes of the strand, intermediate iron cores 5 of chosen sizes may then be fitted between these main parts to form the external closed iron core. It is, of course, not ruled out that more than one core 5 could be used to bridge the gap between each end of the cores 1*a*, 2*a*.

It would also be possible to replace each sub-stirrer 1 and 2 by a whole stirrer, each individual stirrer thus comprising all the pluri-phase coils required. In this case as many intermediate iron cores 5 as are required to complete the external magnetic circuit are arranged between the cores of the stirrers 1, 2. By a suitable choice of phase sequence fed to each stirrer 1, 2, i.e., opposite phase sequences in the arrangement shown in FIG. 1, a stirring scheme giving rise to melt flow in the directions of the arrows 9 can be obtained.

The invention is not to be seen as being limited to the arrangement illustrated, since this can be varied in many ways within the scope of the following claims. For example, although a mold box 3 of rectangular cross-section is shown it is possible to have arcuate stirrer members which can combine without intermediate cores to surround a circular mold or with intermediate cores to surround a mold having an oval (or race-track shaped) cross-section.

What is claimed is:

1. A mold stirrer for the electromagnetic stirring of a molten metal strand in a mold having opposite sides during continuous casting, the mold stirrer including two stirrer members located outside the mold and respectively adjacent said opposite sides thereof, each stirrer member having opposite ends which respectively face corresponding ends of the other stirrer member, and each stirrer member being provided with an iron core and an electrical coil, and a pair of intermediate iron cores which are respectively placed between corresponding ends of said stirrer members, whereby said intermediate iron cores, together with the cores of the stirrer members, form a closed magnetic circuit around the mold to enable rotation of the cast metal normal to the casting direction.

2. A mold stirrer according to claim 1, wherein each of said two stirrer members includes coils for half a stirrer, said stirrer members being arranged to jointly act as a single stirring means.

3. A mold stirrer according to claim 1, wherein each of said two stirrer members is an independent stirring means, said two stirrer members being arranged to act in concert to achieve the required rotation of the cast molten metal.

4. A mold stirrer according to claim 1, wherein said intermediate iron cores are replaceable with iron cores of different dimensions for different sizes of strand and mold.

5. A mold stirrer according to claim 1, wherein at least one plate of an electrically-conducting material is interposed between each of said two stirrer members and the continuous strand of cast metal.

6. A mold stirrer according to claim 2, wherein at last one plate of an electrically-conducting material is interposed between each of said two stirrer members and the continuous strand of cast metal.

7. A mold stirrer according to claim 3, wherein at least one plate of an electrically-conducting material is interposed between each of said two stirrer members and the continuous strand of cast metal.

8. A mold stirrer according to claim 1, wherein at least one plate of copper is interposed between each of said two stirrer members and the continuous strand of cast metal.

9. A mold stirrer according to claim 1, wherein at least one plate of laminated copper is interposed between each of said two stirrer members and the continuous strand of cast metal.

* * * * *